US009675868B2

(12) United States Patent
Willis

(10) Patent No.: US 9,675,868 B2
(45) Date of Patent: Jun. 13, 2017

(54) SKATEBOARD WITH ENGRAVED GRIP SURFACE

(71) Applicant: RAYZIST PHOTOMASK, INC., Vista, CA (US)

(72) Inventor: Gabriel Ray Willis, Vista, CA (US)

( * ) Notice: Subject to any disclaimer, the term of this patent is extended or adjusted under 35 U.S.C. 154(b) by 204 days.

(21) Appl. No.: 14/374,490

(22) PCT Filed: Feb. 6, 2013

(86) PCT No.: PCT/US2013/024834

§ 371 (c)(1),
(2) Date: Jul. 24, 2014

(87) PCT Pub. No.: WO2013/119600

PCT Pub. Date: Aug. 15, 2013

(65) Prior Publication Data

US 2014/0375009 A1 Dec. 25, 2014

Related U.S. Application Data

(60) Provisional application No. 61/596,300, filed on Feb. 8, 2012.

(51) Int. Cl.
*A63C 17/01* (2006.01)
*B24C 1/04* (2006.01)

(52) U.S. Cl.
CPC ..... *A63C 17/017* (2013.01); *A63C 17/01* (2013.01); *A63C 17/012* (2013.01); *B24C 1/04* (2013.01); *B24C 1/045* (2013.01); *A63C 2203/08* (2013.01); *A63C 2203/42* (2013.01); *Y10T 428/24479* (2015.01)

(58) Field of Classification Search
CPC ..... A63C 17/01; A63C 17/262
USPC ..... 280/87.042
See application file for complete search history.

(56) References Cited

U.S. PATENT DOCUMENTS 3,771,811 A * 11/1973 Bueno ..... A63C 17/01 280/87.042
3,827,334 A * 8/1974 English ..... B44B 3/00 125/6
3,857,025 A * 12/1974 English ..... B44B 3/00 318/568.1
3,975,983 A * 8/1976 Stockman ..... B44B 1/00 409/126
3,975,985 A * 8/1976 Stockman ..... B44B 1/00 409/130
4,328,274 A * 5/1982 Tarbutton ..... A63C 17/01 428/142
4,337,963 A * 7/1982 Stevenson ..... A63C 17/017 280/610
4,921,513 A * 5/1990 Parten ..... A63C 5/003 156/153

(Continued)

FOREIGN PATENT DOCUMENTS

GB 2133326 1/1984
WO 9221065 6/1992

*Primary Examiner* — Jeffrey J Restifo

(57) ABSTRACT

A recreational sports board includes an engraved upper surface providing an attractive detailed image having recessed portions with sufficient depth so as to also provide a suitable grip surface for the rider's feet. A depth of the recessed portions may vary across the board from one location to another location relative to the top side of the board.

11 Claims, 5 Drawing Sheets

(56) References Cited

U.S. PATENT DOCUMENTS 5,622,759 A * 4/1997 Fuster ..... A63C 5/124
280/87.01
6,182,986 B1 * 2/2001 Smith ..... A63C 17/01
280/610
6,386,561 B1 * 5/2002 Hanson ..... A63C 17/01
280/11.27
6,854,748 B2 * 2/2005 Wimbish ..... A63C 17/017
280/14.21
7,854,068 B2 * 12/2010 Di Benedetto ..... B23Q 15/14
33/18.1
7,897,233 B2 * 3/2011 Esposito ..... A63C 5/003
156/249
D692,079 S * 10/2013 Mackay ..... A63C 17/01
D21/765
8,574,705 B2 * 11/2013 Hunter ..... A63C 17/01
280/87.042
2004/0188967 A1 * 9/2004 Gallo ..... A63C 17/01
280/87.041
2005/0042370 A1 2/2005 McManus
2006/0125199 A1 * 6/2006 Kodames ..... A63C 17/01
280/87.042
2007/0069492 A1 * 3/2007 Lin ..... A63C 17/01
280/87.042
2008/0020166 A1 * 1/2008 Esposito ..... A63C 5/003
428/41.7
2008/0238013 A1 * 10/2008 Woodall ..... A63C 17/01
280/87.042
2008/0296858 A1 * 12/2008 Burwell ..... A63C 17/01
280/87.042
2010/0164194 A1 * 7/2010 Dykema ..... A63C 17/01
280/87.042
2010/0233435 A1 9/2010 Hunter
2012/0018970 A1 * 1/2012 Thompson ..... A63C 17/017
280/87.042
2014/0375008 A1 * 12/2014 Fissell ..... A63C 17/26
280/87.042
2014/0375009 A1 * 12/2014 Willis ..... A63C 17/017
280/87.042

* cited by examiner

SKATEBOARD WITH ENGRAVED GRIP SURFACE

CROSS-REFERENCE TO RELATED APPLICATIONS

This application claims the benefit of U.S. Provisional Application No. 61/596,300, filed Feb. 8, 2012, which is incorporated herein by reference in its entirety.

TECHNICAL FIELD

The present technology relates generally to recreational sports boards, and more particularly to a grip surface for a recreational sports board.

BACKGROUND

Known recreational sports boards typically include a deck formed essentially on an elongated board. Such boards may include grip tape adhered to an upper surface of the deck to increase the coefficient of friction between the deck and the rider's feet. However, the grip tape may degrade over time losing its effectiveness and becoming a detraction to the aesthetics of the board.

SUMMARY

An exemplary embodiment of a recreational sports board in accordance with the present technology includes an engraved upper surface providing an attractive detailed image having recessed portions with sufficient depth so as to also provide a suitable grip surface for the rider.

Another exemplary embodiment of a recreational sports board in accordance with the present technology comprises an elongated board for supporting a rider thereon. The board has a top side and an underside. The top side of the board includes a pattern engraved therein thereby forming a grip surface providing an increased coefficient of friction. The grip surface includes recessed portions and non-recessed portions. The recessed portions define a recessed depth relative to the top side of the board which varies from a first location to a second location across the board.

One aspect of the present technology includes a method of making a recreational sports board. The method comprises 1) providing an elongated board for supporting a rider thereon, wherein the board has a top side and an underside; and 2) engraving a pattern in the top side of the board thereby forming a grip surface configured to provide an increased coefficient of friction between the board and the rider, wherein the grip surface includes recessed portions and non-recessed portions. The pattern may be engraved in such a manner the recessed portions define a recessed depth relative to the top side of the board which varies from a first location to a second location across the board.

Another aspect of the present technology includes a method of forming a grip surface on a recreational sports board. The recreational sports board includes an elongated board for supporting a rider thereon, wherein the board has a top side including an outer surface having a first coefficient of friction (typically between the outer surface and the rider's feet) and an underside opposite the top side. The method includes adhering a photoresist film to the top side of the board and sandblasting the top side of the board such that the photoresist film acts as a stencil allowing selected unmasked portions of the board to be removed while other masked portions remain intact, thereby forming an engraved pattern in the board. The engraved pattern includes recessed portions and non-recessed portions forming a grip surface having a second coefficient of friction (between the grip surface and the rider's feet) greater than the first coefficient of friction.

Other aspects, features, and advantages of the present technology will become apparent from the following detailed description when taken in conjunction with the accompanying drawings, which are a part of this disclosure and which illustrate, by way of example, different aspects of this technology.

BRIEF DESCRIPTION OF THE DRAWINGS

The accompanying drawings facilitate an understanding of various embodiments wherein.

DETAILED DESCRIPTION OF ILLUSTRATED EXAMPLES

The following description is provided in relation to several examples (most of which are illustrated) which may share some common characteristics and features. It is to be understood that one or more features of any one example may be combinable with one or more features of the other examples. In addition, any single feature or combination of features in any of the examples may constitute additional examples.

Figure 1:
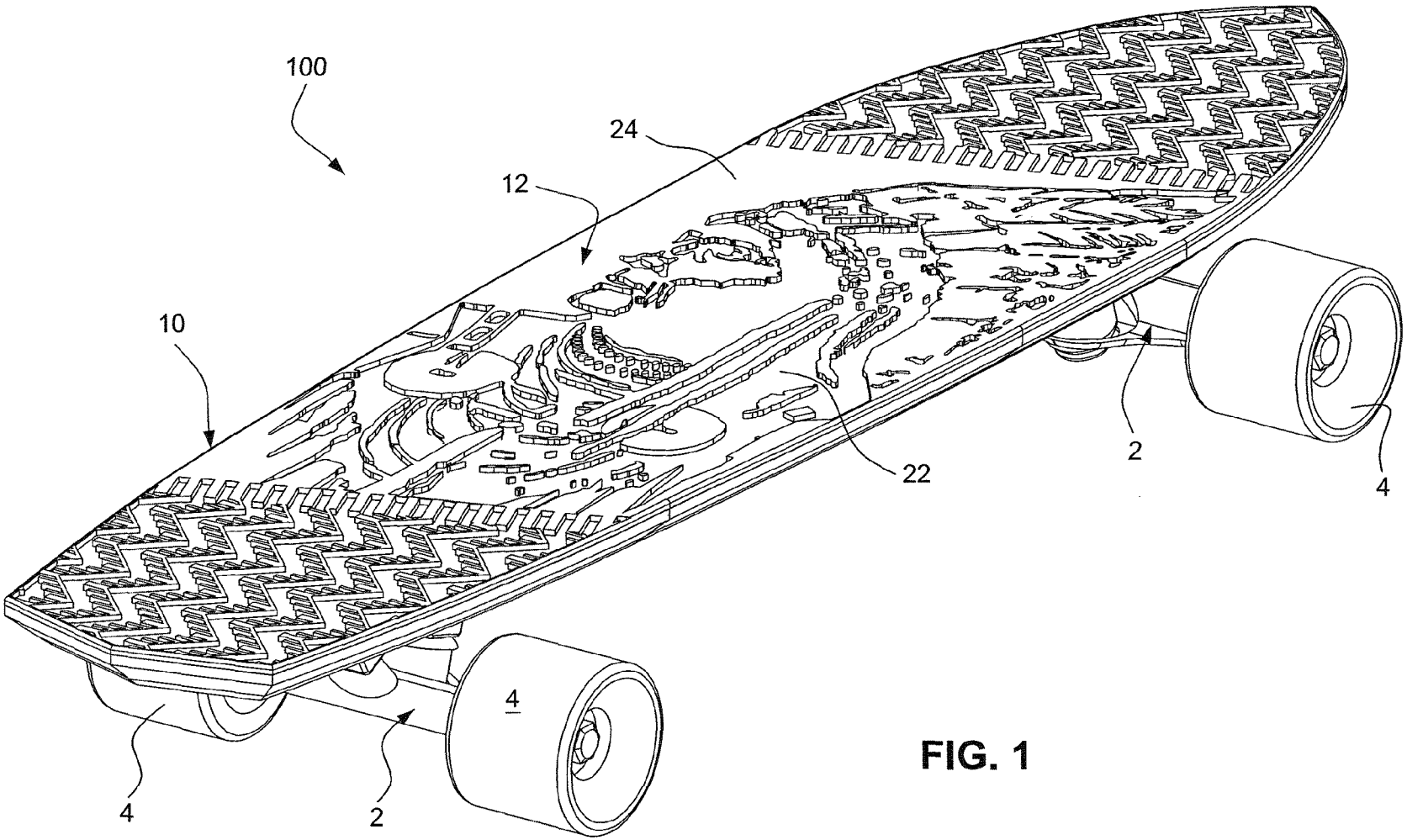
FIG. 1 is a perspective view of an example skateboard.
Figure 3:
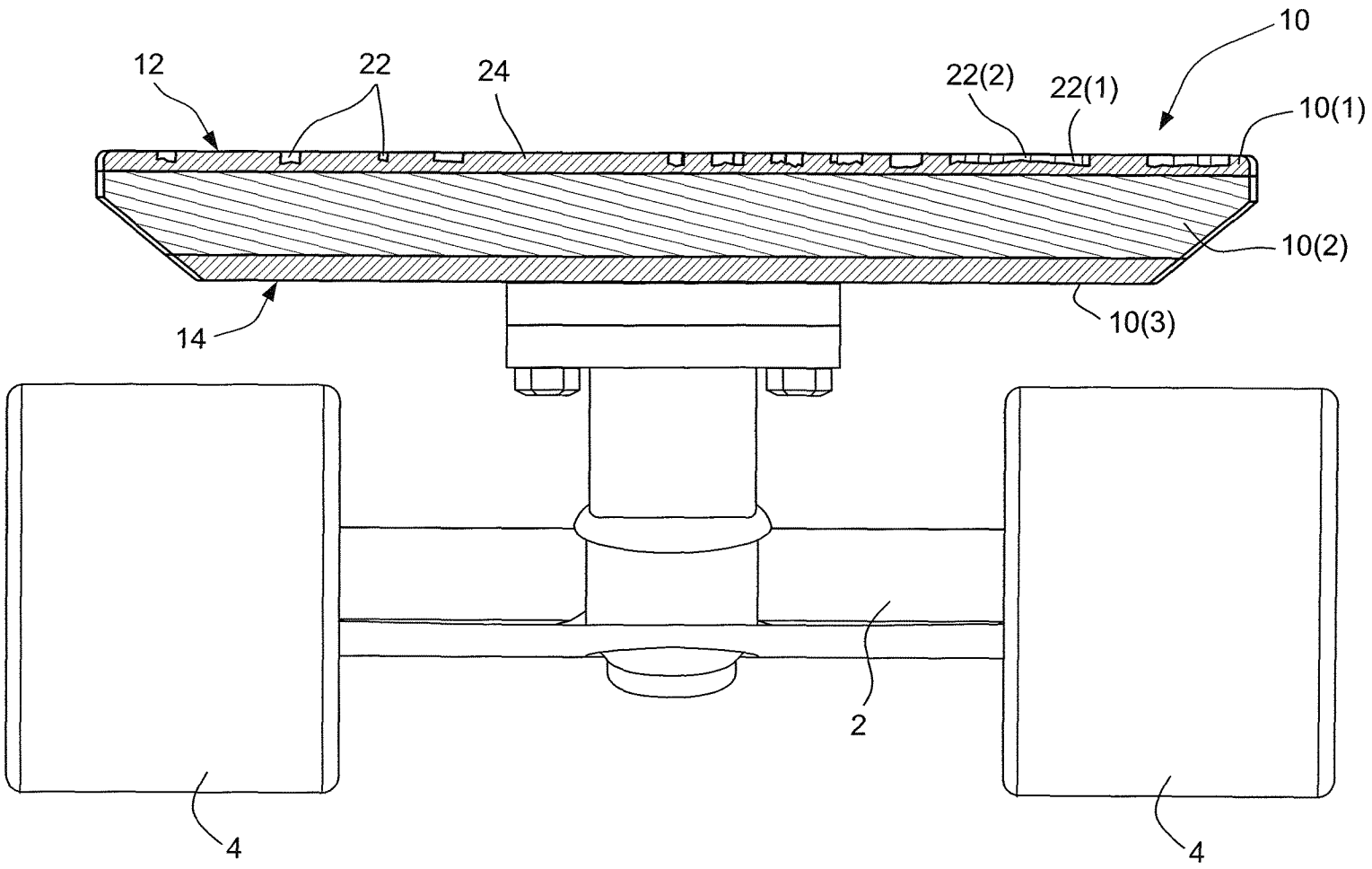
FIG. 3 is a cross-sectional view along the line 3-3 of FIG. 2.

The disclosed technology relates to a grip surface on a recreational sports board (e.g., skateboard, surfboard, etc.). In the illustrated example of FIG. 1, a skateboard 100 is shown. The skateboard 100 includes a deck 10 and a pair of trucks 2 each having a set of wheels 4 to allow the skateboard 100 to roll along a surface. The deck 10 is essentially an elongated board preferably made of wood; however, the deck could be made from another suitable material such as a molded plastics material. The deck has a top side 12 on which a rider typically stands when riding the skateboard 100 and an underside 14 opposite the top side, as best shown in FIGS. 1 and 3. The trucks 2 are attached to the underside 14 of the skateboard and the wheels 4 are connected to the trucks 2 as one skilled in the art will understand.

Figure 2:
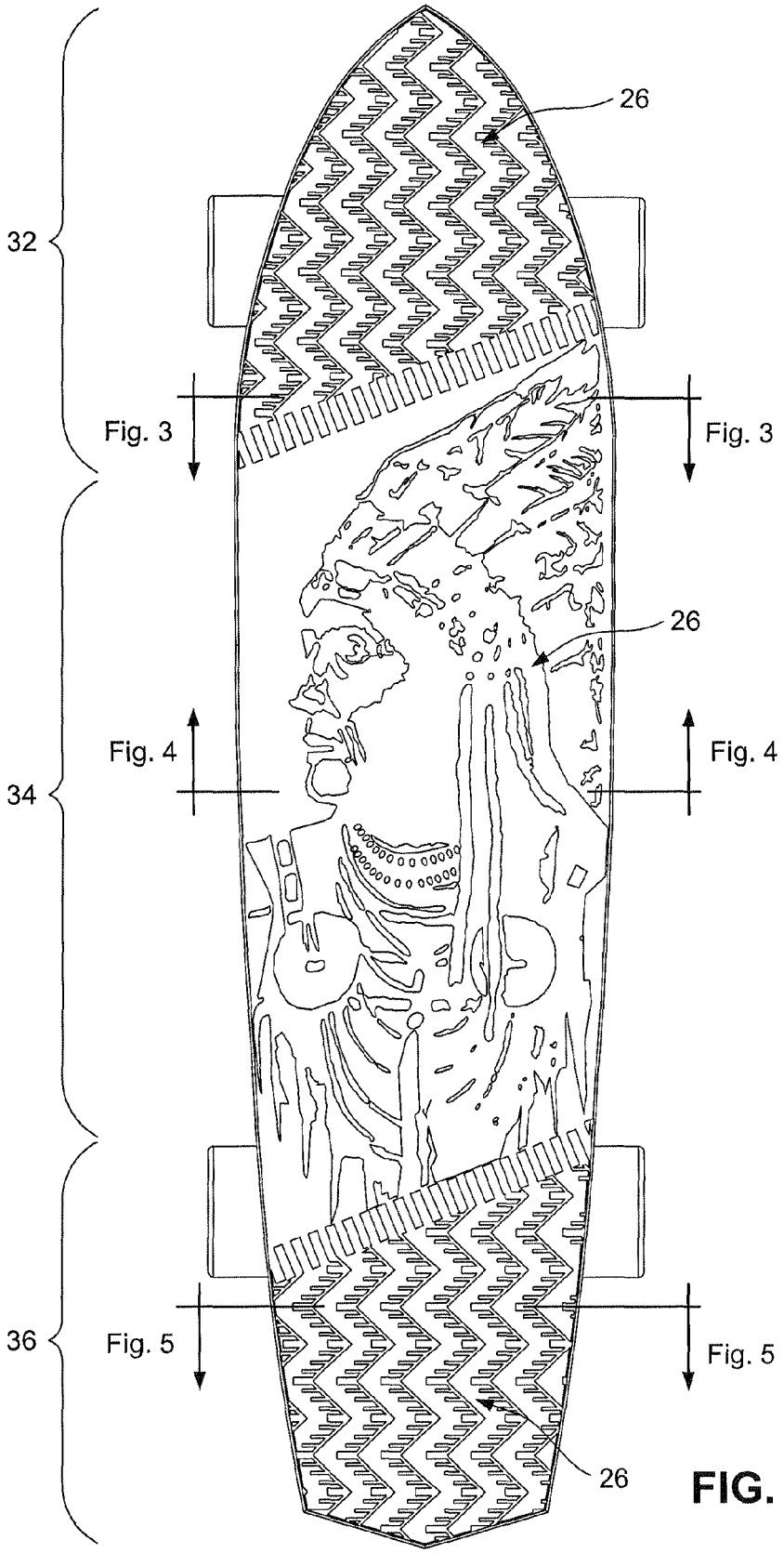
FIG. 2 is a top view of the skateboard of FIG. 1.
Figure 4:
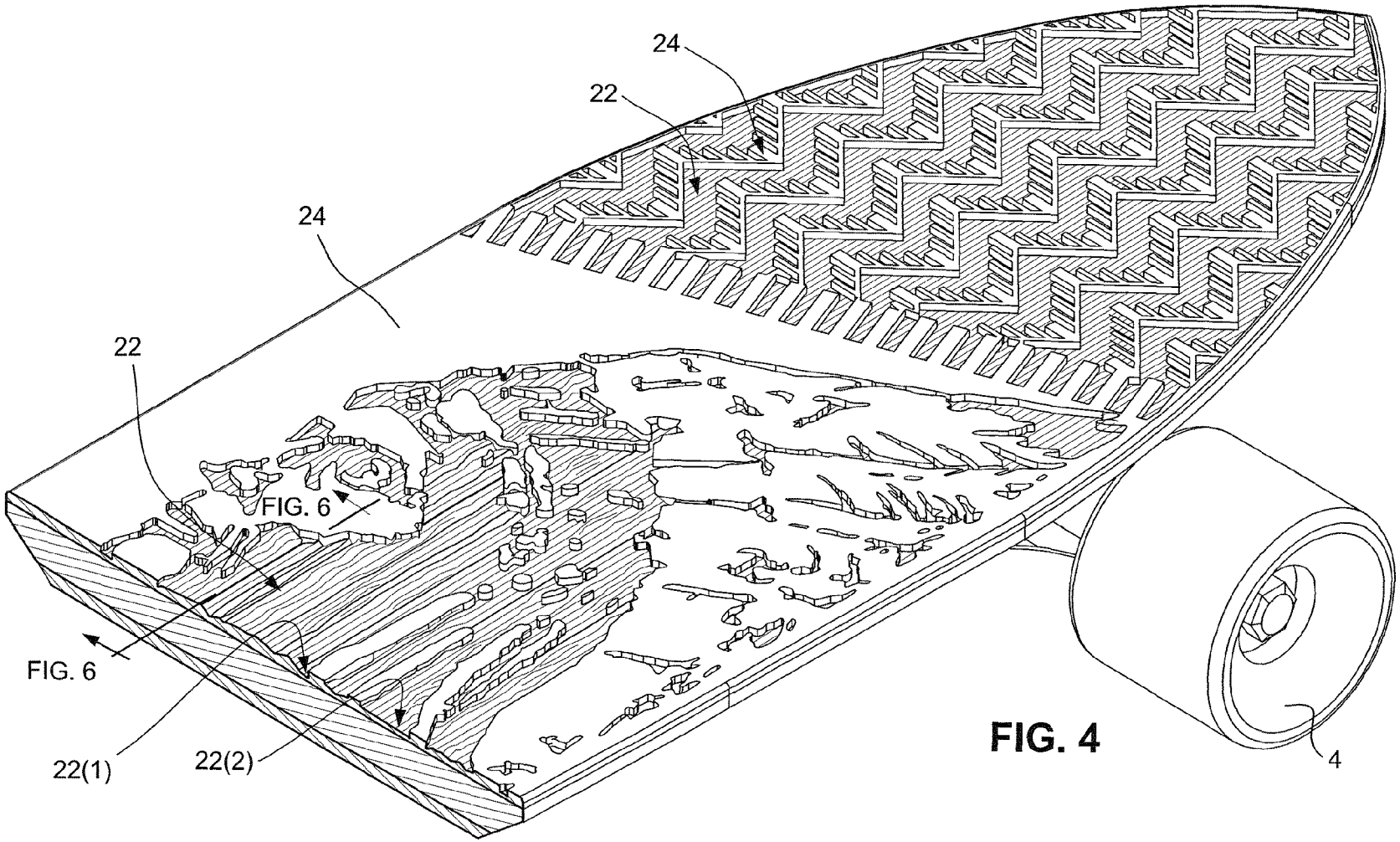
FIG. 4 is a perspective view showing the cross-section represented by the line 4-4 of FIG. 2.

As shown in FIGS. 1, 2 and 4, the top side 12 of the deck 10 includes an engraved pattern formed by recessed portions 22 and non-recessed portions 24. The pattern may be formed using any suitable method (e.g., sandblasting, laser engraving, hand engraving and router engraving). For instance, a router operated under computer numerical control (CNC) may be used. In the illustrated example, the pattern is formed by sandblasting. A suitable method of sandblasting to form a pattern on a substrate using a photomask is described in U.S. Pat. No. 5,370,762 to Zukowski and U.S. Pat. No. 5,366,584 to Zukowski, each of which is incorporated herein by reference in its entirety.

Any desired image may be transferred to the photomask (or photoresist film) as one skilled in the art will understand. The photoresist film (not shown) is then adhered to the deck 10 and acts as a stencil or patterned mask allowing selected unmasked portions of the deck to be removed (e.g., by sandblasting) while other masked portions remain intact.

After the recessed portions 22 are formed during the sandblasting process, the photoresist film may be left in placed on the deck 10 so as to form a stencil for applying paint to the deck. That is, the photoresist film will cover the non-recessed portions 24 such that paint may be easily applied to the recessed portions 22.

The provision of recessed portions 22 having sufficient depth in conjunction with the non-recessed portions 24 forms a grip surface 26 on the top side 12 on the deck 10. A coefficient of friction between the grip surface and an object in contact with the grip surface (e.g., typically the rider's feet, either within a shoe or bare foot) is increased to a sufficient value to provide a suitable degree of "grip" as compared to the top side 12 of the deck before engraving. This increased coefficient of friction is achieved by an unevenness of the grip surface 26 provided by a sufficient depth of the recessed portions 22.

The sandblasting process engraves the deck 10 in a manner which removes enough deck material so as to achieve a sufficient depth in the recessed portions 22 such that the coefficient of friction between the grip surface 26 and the rider is increased to provide a suitable degree of "grip" to the top side 12 of the deck. The sandblasting process also enables an intricate and highly detailed image to be engraved into the top side 12 of the deck 10. For example, image details smaller than 0.0625 inches can be clearly represented.

The increased coefficient of friction between the rider's feet and the top side of the deck 10 enables the deck to "hold" the rider's feet on the deck while also allowing the rider's feet to be easily "released" for readjustment or to perform a trick.

Figure 5:
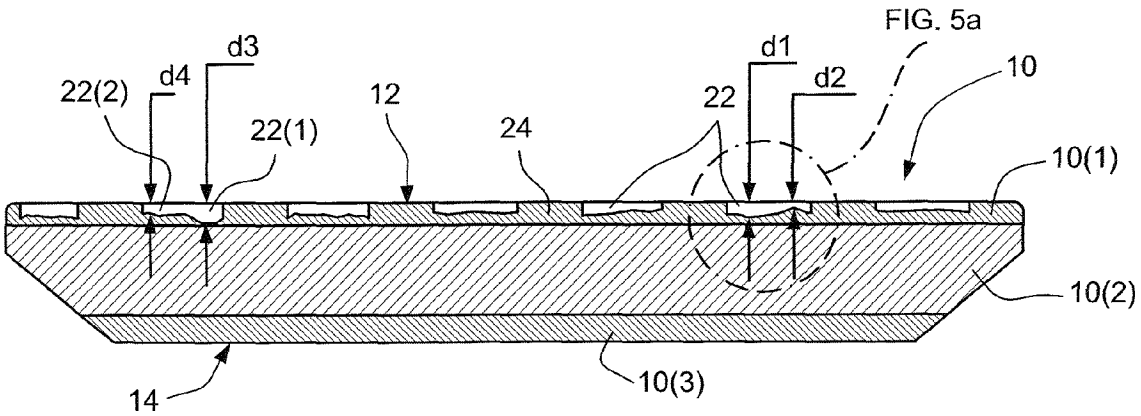
FIG. 5 is a cross-sectional view along the line 5-5 of FIG. 2.
Figure 6:
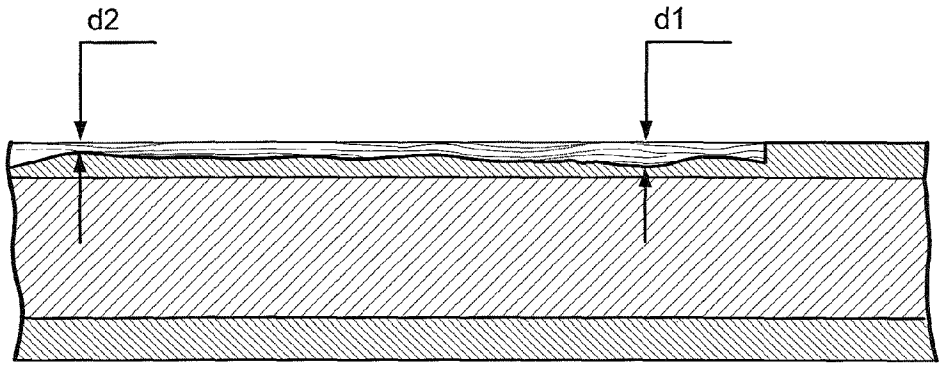
FIG. 6 is a cross-sectional view along the line 6-6 of FIG. 4.
Figure 5A:
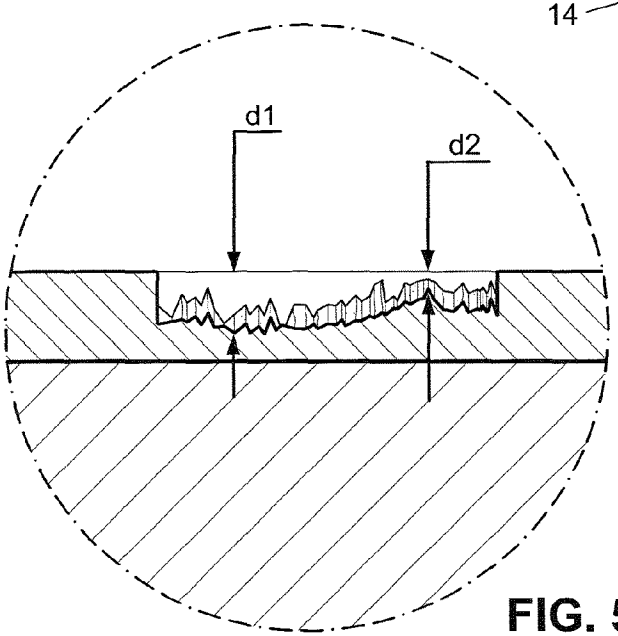

As noted previously, recessed portions 22 define a depth relative to the top side 12 of the deck 10. As is shown in FIGS. 5 and 6, recessed portions 22 may define varying depths d1 and d2, where d1 and d2 represent differing depths at any two points across the grip surface 26. Such depths d1 and d2 may thus provide continual depth variation across the grip surface 26 from one location to another location relative to the top side 12 of the deck 10, as shown for example in FIGS. 5*a* and 6.

In the illustrated embodiments, the random differences in depth of the recessed portions 22 occurs in a widthwise extent of the deck 10. However, random depth variations of the recessed portions may be provided in a lengthwise extent of the deck 10. These widthwise or lengthwise depth variations in turn create respective lengthwise or widthwise extending generally linear striations of alternating peaks and valleys. Preferably, one set of peaks and valleys will have respectively different depths as compared to the depths of adjacent sets of peaks and valleys. Moreover, as shown, e.g., in FIG. 6, the depths of peaks and/or valleys can also vary randomly along the longitudinal extent of the individual striations. Such random variation in both depths in both the lengthwise and/or widthwise extents of the recessed portions 22 and the generally linear striations that are formed thereby may provide a desirable aesthetic quality in addition to increasing the frictional coefficient as has been explained previously. For instance, recessed portions having an increased depth may enhance the clarity of the image.

Accordingly, as shown in FIGS. 3-5, the top side of the deck 10 may include first relatively deeper recessed areas 22(1) of a depth d3 and second relatively shallower recessed areas 22(2) of a depth d4 such that d4<d3, where d3 and d4 represent deeper/shallower areas at any two points across the grip surface 26. One skilled in the art will understand that since the recessed portions 22 may provide continual and random depth variation, any number of relatively deeper recessed areas 22(1) and relatively shallower recessed areas 22(2) having varying depths may be provided.

The grip surface 26 may provide a desirable tactile quality to a bare foot rider due to the unevenness of the grip surface provided by the recessed portions 22 and non-recessed portions 24. Thus, the depth of the recessed portions 22 may be varied (e.g., randomly) to enhance such tactile quality.

Further, the coefficient of friction between the grip surface 26 and the rider's foot may be further increased by increasing the depth of selected recessed portions 22 and/or selected areas within certain recessed portions 22. Thus, the grip surface 26 may be designed such that areas of the grip surface 26 where a higher coefficient of friction is desired may be provided with a greater recessed depth.

In an example shown in FIG. 2, a front portion 32 and a rear portion 36 of the grip surface 26 may be provided with a greater recessed depth than a middle portion 34 of the grip surface since a rider may typically place one foot on the front portion 32 and the other foot on the rear portion 36 of the grip surface 26 when riding the skateboard. However, the areas of the grip surface 26 having a higher coefficient of friction between the grip surface 26 and the rider's foot may be provided in any desired area of the grip surface 26 (e.g., the middle portion 34).

Any one of the depths d1-d4 within the recessed portions 22 may be about 0.0625 to 0.375 inches, preferably about 0.1875 to 0.375 inches and more preferably about 0.1875 and 0.25 inches.

In the illustrated example, the deck 10 is formed of a multi-layer laminate structure, as shown in FIGS. 3 and 5. The deck 10 may include a first layer 10(1) toward the top side 12 of the deck, a second middle layer 10(2) and a third layer 10(3) toward the underside 14 of the deck. However, the deck may include any number of layers, including a single monolithic layer. The recessed portions 22 are formed in the first layer 10(1) or in an upper surface region of a single monolithic layer.

While the examples discussed above have been described in connection with what are presently considered to be practical and preferred features, it is to be understood that appended claims are intended to cover modifications and equivalent arrangements included within the spirit and scope of these examples.

What is claimed is:

1. A recreational sports board, comprising:

an elongated board for supporting a rider thereon, the board having a top side and an underside, wherein the top side of the board includes a pattern engraved therein thereby forming a grip surface configured to provide an increased coefficient of friction between the board and the rider, the grip surface including recessed portions and non-recessed portions, wherein the recessed portions define varying depths relative to the top side of the board from a first location to a second location across the board, wherein the varying depths on the pattern engraved forming the grip surface provide the increased coefficient of friction between the board and the rider, wherein the top side of the board comprises a photoresist film, wherein the pattern on the board is sandblasted through the photoresist film, and wherein the recessed portions define randomly varying depths relative to the top side of the board.

2. The recreational sports board of claim 1, wherein the board includes a multi-layer laminate structure having a first upper layer and a second lower layer.

3. The recreational sports board of claim 2, wherein the pattern is formed in the first upper layer.

4. The recreational sports board of claim 1, wherein the recessed depth is between 0.125 and 0.375 inches.

5. The recreational sports board of claim 1, wherein a depth of the recessed portions in a front portion and a rear portion of the board is greater than a depth of the recessed portions in a middle portion of the board.

6. The recreational sports board of claim 1, further comprising a pair of trucks connected to the underside of the board, and a pair of wheels rotatably installed on each truck.

7. The recreational sports board of claim 1, wherein the varying depths form generally linearly extending striations.

8. The recreational sports board of claim 7, wherein the striations include adjacent sets of peaks and valleys having randomly different depths.

9. The recreational sports board of claim 1, wherein the randomly varying depths occur in a widthwise extent of the board or a lengthwise extent of the board.

10. The recreational sports board of claim 1, wherein the pattern engraved therein thereby forming the grip surface comprises an image.

11. The recreational sports board of claim 10, wherein the image is engraved using the photoresist film.

* * * * *